US005967821A

United States Patent [19]

Sugiyama

[11] Patent Number: 5,967,821

[45] Date of Patent: Oct. 19, 1999

[54] BUS BAR-HOLDING STRUCTURE

[75] Inventor: Norio Sugiyama, Shizuoka, Japan

[73] Assignee: Yazaki Corporation, Tokyo, Japan

[21] Appl. No.: 09/078,136

[22] Filed: May 14, 1998

[30] Foreign Application Priority Data

May 15, 1997 [JP] Japan ..... 9-125517

[51] Int. Cl.[6] ..... H01R 13/64

[52] U.S. Cl. ..... 439/246

[58] Field of Search ..... 439/246–252

[56] References Cited

U.S. PATENT DOCUMENTS

| | | | |
|---|---|---|---|
| 4,738,631 | 4/1988 | Takahashi et al. | 439/246 |
| 4,810,215 | 3/1989 | Kaneko | 439/246 |
| 4,968,263 | 11/1990 | Silbernagel et al. | 439/246 |
| 5,249,978 | 10/1993 | Gazda et al. | 439/246 |

FOREIGN PATENT DOCUMENTS 63-120370 8/1988 Japan .

*Primary Examiner*—Gary Paumen

*Attorney, Agent, or Firm*—Morgan, Lewis & Bockius LLP

[57] ABSTRACT

A bus bar-holding structure includes a bus bar-holding member to which a bus bar including a base portion, a terminal portion and a bent portion formed between the base portion and the terminal portion is attachable, the bus bar-holding member having an insertion hole formed therein, in which the terminal portion of the bus bar is slidably movable in the insertion hole and partially projectable from the bus bar-holding member outwardly, a retaining member retaining a part of the base portion of the bus bar spaced from the bent portion, and a projection amount-limiting portion abutted against an inner side portion of the bent portion of the bus bar. Therefore, the bus bar can be elastically deformed and flexed about the retaining member in a retracting direction of the terminal portion. When the bus bar-holding member is to be insert molded in a housing, the terminal portion which is excessively-projected is forced back by a mold for forming the housing, and is retracted relatively to an amount corresponding to a difference from a proper projection amount.

7 Claims, 5 Drawing Sheets

BUS BAR-HOLDING STRUCTURE

BACKGROUND OF THE INVENTION

1. Field of the Invention

This invention relates to a bus bar-holding structure in which a bus bar-holding member holds bus bars therein, and have insertion holes through which the bus bars project outwardly, respectively.

2. Background

A bus bar-holding member holds bus bars therein, and each of the bus bars has a tab terminal for fitting connection to a mating external terminal, and the bus bar-holding member has insertion holes through which the tab terminals project outwardly, respectively.

When this bus bar-holding member is combined with a housing or the like having the mating terminals, the outwardly-projecting tab terminals are fittingly connected respectively to the mating terminals.

If there is an error in the position of each tab terminal relative to its mating terminal, the two terminals are incompletely fitted together when the two members are combined together, or the two terminals are forcibly fitted together, thus causing damage to the terminals.

The amount of projection of the tab terminals is varied by a total error caused by the combination of a manufacturing dimensional error of the bus bars (including the tab terminals), a dimensional error in the position of mounting of the bus bars relative to the bus bar-mounting member, and a play in the mounting portion.

A prior art technique of reducing the play in the mounting portion is disclosed, for example, in Unexamined Japanese Utility Model Publication No. Sho. 63-120370.

In the technique disclosed in the above publication, stoppers for limiting the movement of each tab terminal projecting from an insertion hole of a bus bar-holding member in an extended and a retracted direction are provided on the tab terminal, and a reinforcement portion for pressing contact with the insertion hole is provided on the tab terminal.

However, there are encountered variations in the degree of press fitting of the tab terminal, the inclination of the tab terminals and the length of the tab terminals, and because of the sum of these errors, all of the tab terminals can not be projected accurately to the same amount, and therefore there remains a problem that the tab terminal may be fitted relative to the mating terminal incompletely or excessively.

SUMMARY OF THE INVENTION

This invention seeks to overcome the above problem, and an object of the invention is to provide a bus bar-holding structure in which an error in the position of each tab terminal relative to a mating terminal can be absorbed.

To achieve the above object, according to an aspect of the present invention, there is provided a bus bar-holding structure which comprises: a bus bar-holding member to which a bus bar including a base portion, a terminal portion and a bent portion formed between the base portion and the terminal portion is attachable, the bus bar-holding member including an insertion hole formed therein, in which the terminal portion of the bus bar is slidably movable in the insertion hole and partially projectable from the bus bar-holding member outwardly; a retaining member retaining a part of the base portion of the bus bar spaced from the bent portion; and a projection amount-limiting portion abutted against an inner side portion of the bent portion of the bus bar, in which the bus bar can be elastically deformed and flexed about the retaining member in a retracting direction of the terminal portion.

More specifically, the base portion of the bus bar can be elastically deformed and flexed about the retaining member in accordance with a slide movement of the terminal portion.

Preferably, a projection amount of the terminal portion from the bus bar-holding member is limited to a maximum amount obtained when the bus bar abuts against the projection amount-limiting portion.

The bus bar-holding structure may further comprise a housing in which the bus bar-holding member is insert molded, the projection amount of the terminal portion from the bus bar-holding member is limited by a mold for forming the housing so that the terminal portion is retracted relatively to an excess of the projection amount corresponding to a difference from a proper projection amount, when the bus bar-holding member is to be insert molded in the housing.

Preferably, the bus bar-holding structure further comprises an insertion groove, in which the bus bar is insertable, formed in an inner surface of the bus bar-holding member, and the retaining member comprises a retaining pawl which retains the bus bar inserted in the insertion groove.

DETAILED DESCRIPTION OF THE PREFERRED EMBODIMENT

Figure 1:
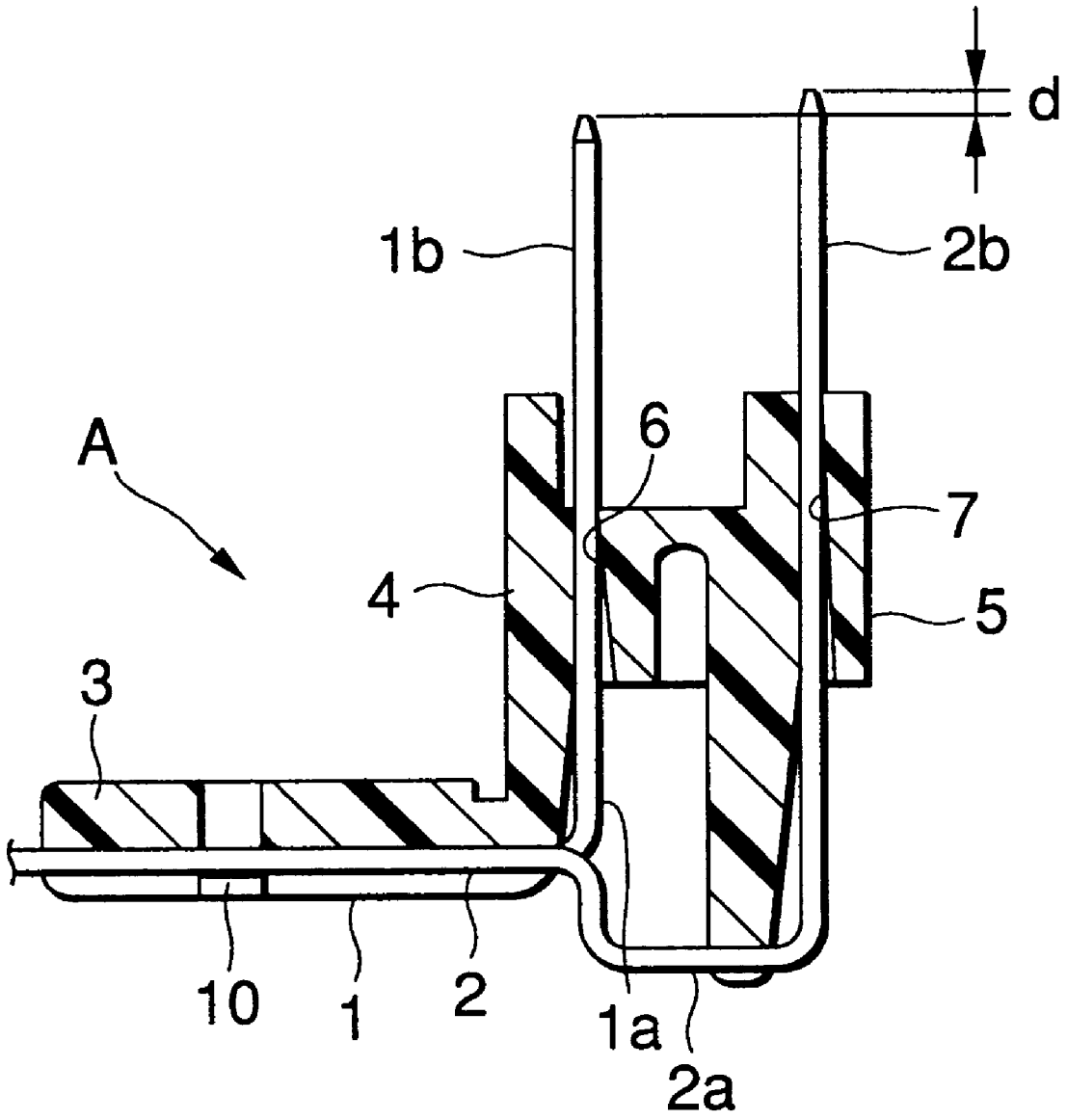
FIG. 1 is a vertical cross-sectional view of a bus bar-holding member, showing a condition before it is insert molded in a housing.

A preferred embodiment of the present invention will now be described with reference to FIGS. 1 to 8.

In this embodiment, although the bus bar-holding member A holds two kinds of bus bars 1 and 2 of different shapes (see FIG. 1), one kind or more than two kinds of bus bars may be held in the bus bar-holding member.

The bus bar 1 has a generally L-shape as a whole, and has a bent portion la extending upwardly from an end thereof, and a tab terminal 1*b* is formed at a distal end of this bent portion 1*a*.

The bus bar 2 has a bent portion 2*a* of a U-shape extending from an end thereof in a slightly downwardly-projected manner, and a tab terminal 2*b* is formed at a distal end of this bent portion 2*a*. Thus, the bus bar 2 has a generally U-shape, with the bent portion 2*a* projected downwardly (see FIG. 1).

The bus bar-holding member A, made of an electrically-insulating material, includes a bus bar-holding wall 3 holding the bus bars 1 and 2 alternately arranged therein, and a holding portion 5 (which is to be insert molded in the housing H) formed on and extending from one side of an interconnecting wall 4 extending upwardly from a right end of the bus bar-holding wall 3. The holding portion 5 has insertion holes 6 through which the tab terminals 1*b* project outwardly, respectively, and insertion holes 7 through which the tab terminals 2*b* project outwardly, respectively (see FIGS. 1 and 5).

Insertion grooves 8 and insertion grooves 9 are alternately formed in an inner surface of the bus bar-holding wall 3, and the bus bars 1 are received respectively in the insertion grooves 8 whereas the bus bars 2 are received respectively in the insertion grooves 9. Retaining pawls 10 are formed on and project respectively from opposed side surfaces of each insertion groove 8, and are sufficiently spaced from the bent portion 1*a* of the bus bar 1 (see FIGS. 6 and 7 and FIG. 8 which shows a portion of FIG. 7 on an enlarged scale).

The retaining pawls 10, serving as a retaining member, are elastically deformed when the bus bar 1 is to be inserted into the insertion groove 8, and allow the passage of the bus bar 1. After the bus bar 1 is inserted into the insertion groove 8, the retaining pawls 10 retain the bus bar 1 against disengagement from the insertion groove 8.

The bus bar 1 has such a thickness that it can be elastically deformed and flexed, and therefore when a downward external force acts on the bent portion 1*a* of the bus bar 1, the bus bar 1 can be easily deformed and flexed downwardly about the retaining pawls 10.

Similar retaining pawls 10 are also formed on and project respectively from opposed side surfaces of each insertion groove 9, and are sufficiently spaced from the bent portion 2*a* of the bus bar 2.

Figure 2:
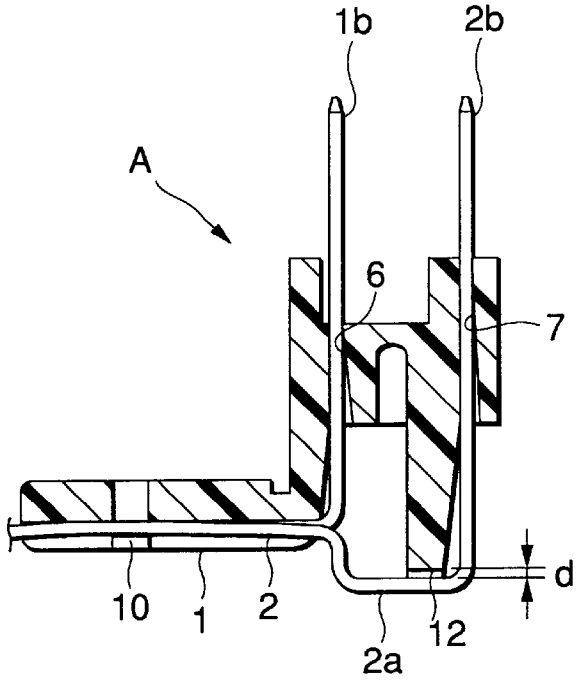
FIG. 2 is a vertical cross-sectional view of the bus bar-holding member, showing the condition of bus bar terminals when the bus bar-holding member is to be insert molded in the housing.
Figure 3:
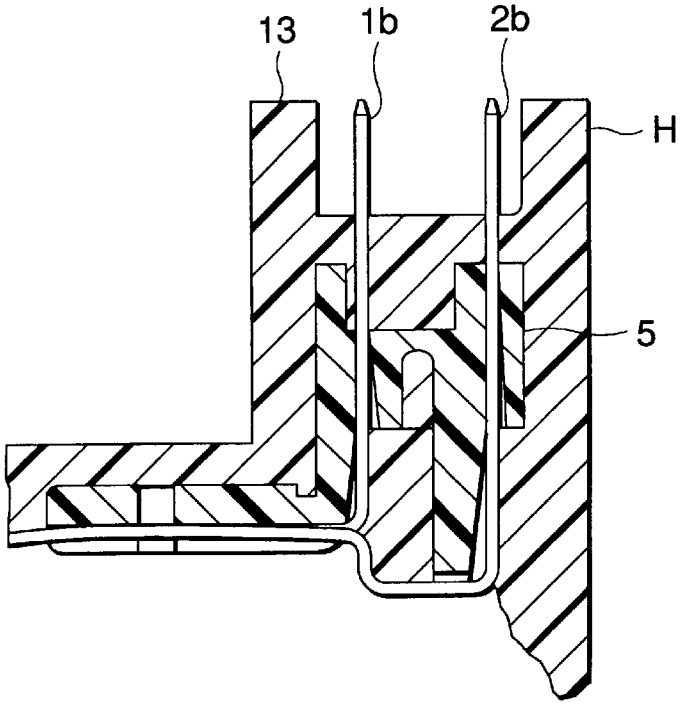
FIG. 3 is a vertical cross-sectional view of the bus bar-holding member insert molded in the housing.
Figure 4:
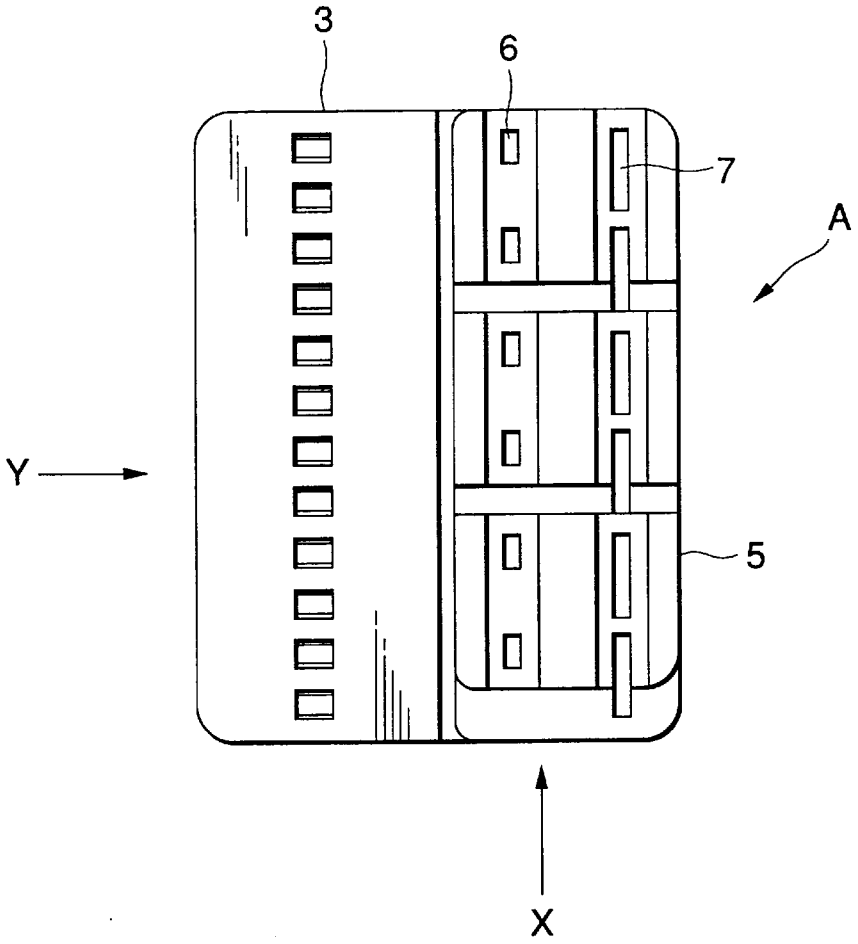
FIG. 4 is a plan view of the bus bar-holding member.
Figure 5:
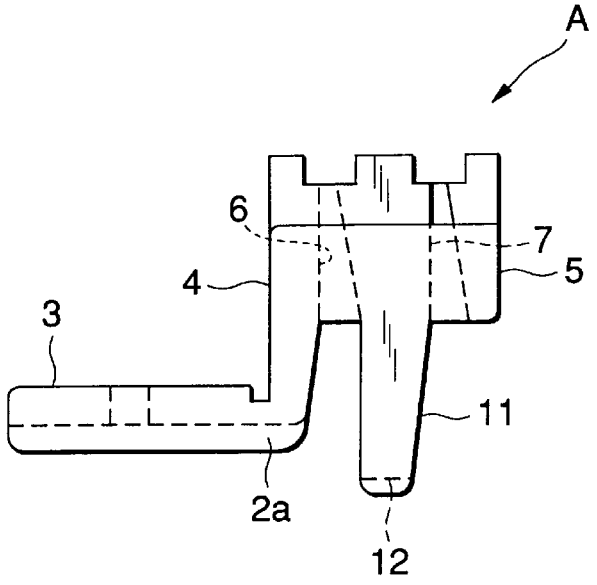
FIG. 5 is a view as seen in a direction of arrow X of FIG. 4.
Figure 6:
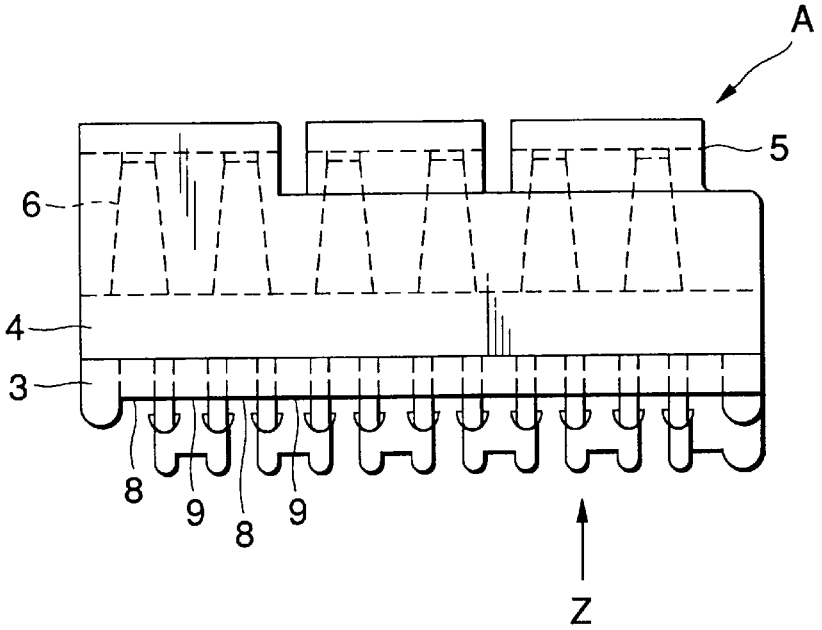
FIG. 6 is a view as seen in a direction of arrow Y of FIG. 4.
Figure 7:
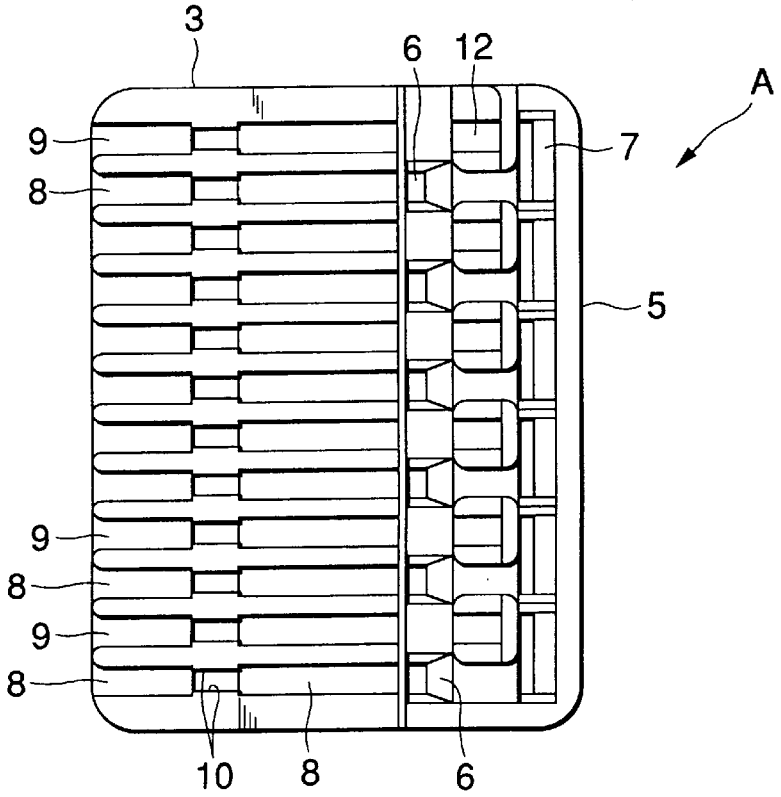
FIG. 7 is a view as seen in a direction of arrow Z of FIG. 6.
Figure 8:
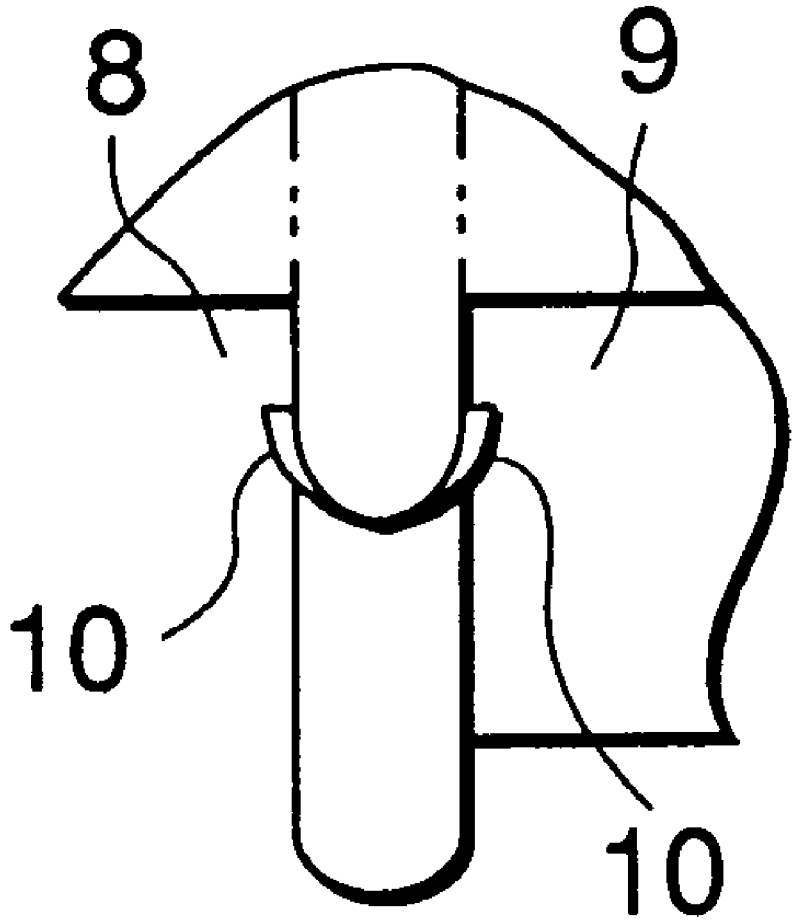
FIG. 8 is an enlarged view of a portion of FIG. 6.

The bus bar 2 has such a thickness that it can be elastically deformed and flexed, and therefore when a downward external force acts on the bent portion 2*a* of the bus bar 2, the bus bar 2 can be easily deformed and flexed downwardly about the retaining pawls 10 (see FIG. 2).

In this embodiment, although there are provided the retaining pawls 10 serving as the retaining members, any other suitable retaining member may be provided in so far as they can retain those portions of the bus bars 1, 2 spaced from the bent portions 1*a*, 2*a*.

Projection amount-limiting portions 11 are formed on a lower surface of the holding portion 5, and project respectively toward the bent portions 2*a* of the bus bars 2. An abutment groove 12 is formed in a distal end surface of each projection amount-limiting portion 11, and the bent portion 2*a* is abutted against the inner surface of the abutment groove 12.

With respect to the bus bars 1, the lower end of the interconnecting wall 4 serves as a projection amount-limiting portion 4*a*, and the end portion of each insertion groove 8 serves as an abutment groove whose inner surface abuts against the bent portion 1*a*.

Before the bus bar-holding member A of the above construction is insert molded in the housing H, the bent portion 1*a* of each bus bar 1, inserted in the insertion groove 8, is abutted against the projection amount-limiting portion 4*a* defined by the lower end of the interconnecting wall 4, and that portion of the bus bar 1, spaced from the bent portion 1*a*, is retained by the retaining pawls 10, and the distal end portion of the tab terminal 1*b* projects outwardly from the insertion hole 6.

The bent portion 2*a* of each bus bar 2, inserted in the insertion groove 9, is abutted against the inner surface of the abutment groove 12 in the projection amount-limiting portion 11, and the amount of projection of the tab terminal 2*b* is the maximum amount slightly larger than the required, proper projection amount.

That portion of the bus bar 2, spaced from the bent portion 2*a*, is retained by the retaining pawls 10, and the distal end portion of the tab terminal 2*b* projects outwardly from the insertion hole 7.

As shown in FIG. 1, there are variations d in the amount of projection of the tab terminals 1*b* and 2*b* because of a total error caused by the combination of a manufacturing dimensional error, a mounting position error and etc.

When the holding portion 5 of the bus bar-holding member A is inserted in the housing H, the tab terminals 1*b* and 2*b* are abutted against a mold (not shown) for forming the housing H by an amount corresponding to the difference from the proper projection amount.

If the bus bar 2 is excessively projected by the amount (variation amount) d, this forced-back bus bar 2 is elastically deformed and flexed by an amount corresponding to this projection amount, so that the tab terminal 2*b* is retracted along the insertion hole 7, and the bent portion 2*a* is brought out of contact with the inner surface of the abutment groove 12 (see FIG. 2).

The bus bars 1 and 2 can be easily deformed and flexed about the retaining pawls 10, and therefore the position of the tab terminals 1*b* and 2*b* is so corrected as to have the proper projection length without receiving any undue external force.

With the above construction of the present invention, when the bus bar-holding member is to be insert molded in the housing, those tab terminals, abutted against the mold for forming the housing, are corrected into the proper position, and therefore variations in the amount of projection of the tab terminals, which has been the problem with the conventional construction, can be solved.

Therefore, it is not necessary to strictly control the precision of the parts, and the increase of the parts-manufacturing cost, which would be needed by the improved precision of the parts, can be avoided.

What is claimed is:

1. A bus bar-holding structure, comprising:

a bus bar-holding member to which a bus bar including a base portion, a terminal portion and a bent portion formed between the base portion and the terminal portion is attachable, the bus bar-holding member including an insertion hole formed therein, wherein the terminal portion of the bus bar is slidably movable in the insertion hole in a mating direction and partially projectable from the bus bar-holding member outwardly in the mating direction;

a retaining member retaining a part of the base portion of the bus bar spaced from the bent portion; and a projection amount-limiting portion abutted against an inner side portion of the bent portion of the bus bar, wherein the bus bar can be elastically deformed and flexed about the retaining member in a retracting direction of the so that the terminal portion is slidably movable in the inserting hole in the mating direction.

2. The bus bar-holding structure of claim 1, wherein the retaining member is arranged in the bus bar-holding member.

3. The bus bar-holding structure of claim 1, wherein the projection amount-limiting portion is arranged on the bus bar-holding member.

4. The bus bar-holding structure of claim 1, wherein the base portion of the bus bar can be elastically deformed and flexed about the retaining member in accordance with a slide movement of the terminal portion.

5. The bus bar-holding structure of claim 1, wherein a projection amount of the terminal portion from the bus bar-holding member is limited to a maximum amount obtained when the bus bar abuts against the projection amount-limiting portion.

6. The bus bar-holding structure of claim 5, further comprising a housing in which the bus bar-holding member is insert molded, wherein when the bus bar-holding member is to be insert molded in the housing, the projection amount of the terminal portion from the bus bar-holding member is limited by a mold for forming the housing so that the terminal portion is retracted relatively to an excess of the projection amount corresponding to a difference from a proper projection amount.

7. The bus bar-holding structure of claim 1, further comprising an insertion groove, in which the bus bar is insertable, formed in an inner surface of the bus bar-holding member, wherein the retaining member comprises a retaining pawl which retains the bus bar inserted in the insertion groove.

* * * * *